United States Patent [19]

Harker

[11] 4,069,929

[45] Jan. 24, 1978

[54] MECHANISM FOR COMPACTING MATERIAL

[75] Inventor: Ralph J. Harker, Madison, Wis.

[73] Assignee: Wisconsin Alumni Research Foundation, Madison, Wis.

[21] Appl. No.: 688,779

[22] Filed: May 21, 1976

Related U.S. Application Data

[63] Continuation-in-part of Ser. No. 584,180, June 5, 1975, abandoned.

[51] Int. Cl.[2] ..... B65F 1/00

[52] U.S. Cl. ..... 214/83.14; 100/156; 100/210; 214/83; 214/83.3

[58] Field of Search ..... 214/83 C, 83.14, 83.18, 214/83.24, 83.3, 38 CB, 503, 508, 510, 518, 17 C, 26; 100/173, 176, 177, 156, 210

[56] References Cited

U.S. PATENT DOCUMENTS

| | | | |
|---|---|---|---|
| 588,125 | 8/1897 | Bundren | 100/156 |
| 2,487,729 | 11/1949 | Richardson | 214/83.3 |
| 2,573,270 | 10/1951 | Miller | 214/83 |
| 2,627,988 | 2/1953 | Thomas et al. | 214/83 |
| 3,319,810 | 5/1967 | Terho | 214/83 |

*Primary Examiner*—Robert J. Spar
*Assistant Examiner*—Lawrence E. Williams
*Attorney, Agent, or Firm*—Howard W. Bremer

[57] ABSTRACT

A material handling apparatus having a storage body, a hopper communicating with it through material compacting or crushing means in which said means comprises a cylindrical roller and a substantially planar material-holding tray capable of movement beneath said cylinder in material compacting relationship therewith.

33 Claims, 16 Drawing Figures

MECHANISM FOR COMPACTING MATERIAL

This application is a continuation-in-part of copending application Ser. No. 584,180 filed June 5, 1975 now abandoned.

The present invention relates to material handling apparatus and especially to refuse handling apparatus.

More particularly, this invention relates to material handling apparatus which have improved packing means.

Still more particularly this invention relates to material handling apparatus which incorporate means for compacting and crushing materials, as in vehicle such as garbage trucks and the like.

Material handling vehicles of the general type contemplated in an embodiment of invention are well known, and comprise a storage body, a tailgate or hopper section, and a scraper-packer assembly within the tailgate section to move material from the tailgate or hopper into the storage body and retain it there under compacting pressure. Many tailgate mounted scraper-packer assemblies have been suggested with a view to obtaining better or more efficient material or refuse handling and compaction. See, for example, U.S. Pat. Nos. 3,297,180; 3,866,778; 3,572,526 and 3,092,269.

One of the major disadvantages with known scraper-packer assemblies in association with such large-scale material-handling and storage apparatus is that there is insufficient compaction of the material load within the storage body. In the handling of materials having a multiplicity of void spaces, such as common household and other refuse where many uncrushed cans, bottles, and uncollapsed paperboard cartons are encountered, the compacting effect of known packer assemblies is insufficient to adequately reduce the material volume. Consequently, the storage body capacity is volume-limited rather than weight-limited and hence a refuse removal vehicle, for example, is not used in as efficient a manner as is disirable.

Another disadvantage with many of the scraper-packer assemblies in current use is the safety hazard presented by the packer blade shearing vertically downward across the lip of the hopper opening in each cycle of the assembly. Such shearing action can readily sever an arm, for example, if it is inadvertently put into the hopper at the point in the cycle.

The present invention avoids these disadvantages — it can permit the storage body capacity on a material-handling vehicle to be more nearly weight-limited than volume limited and is devoid of the shearing action presented by packer blade action in most machines in use today.

Other advantages will also become apparent from the following description. For example, an embodiment of this invention not only accomplishes rolling compaction of material through a reduction of the voids volume but thereby tends to reduce the internal pressure to which the enclosed storage body is subject. Also, this invention permits the material within the storage body to be at all times substantially completely enclosed by that body. (In contrast, with most of the scraper-packer assemblies in current use the passage between the hopper and the storage body of the vehicle is intermittently open as the packer blade moves during the operational cycle permitting previously packed material to fall back into the vehicle hopper from the storage body.) A still further advantage is that the loading hopper in a material-handling vehicle employing the present invention is more accessible at all times since it is never obstructed by the passage of any mechanism such as a packer blade. It will also be evident that this invention will permit the handling of elongated materials, as, for example, tree branches in a refuse handling operation, without requirement to break or cut such materials into shorter pieces as is necessary with the cycling packer blade. In addition, material deposited in the hopper is not height limited and can be piled to the limits of the vertical sides of the hopper. Furthermore, the operational cycle consists primarily of the forward and reverse action of a pair of linear or rigidly mounted cylinders, thus permitting the hydraulic controls to be greatly simplified.

In the accompanying drawings, which represent embodiments of the preferred forms of the invention, the same reference numerals designate the same parts in all of the views.

Figure 2:
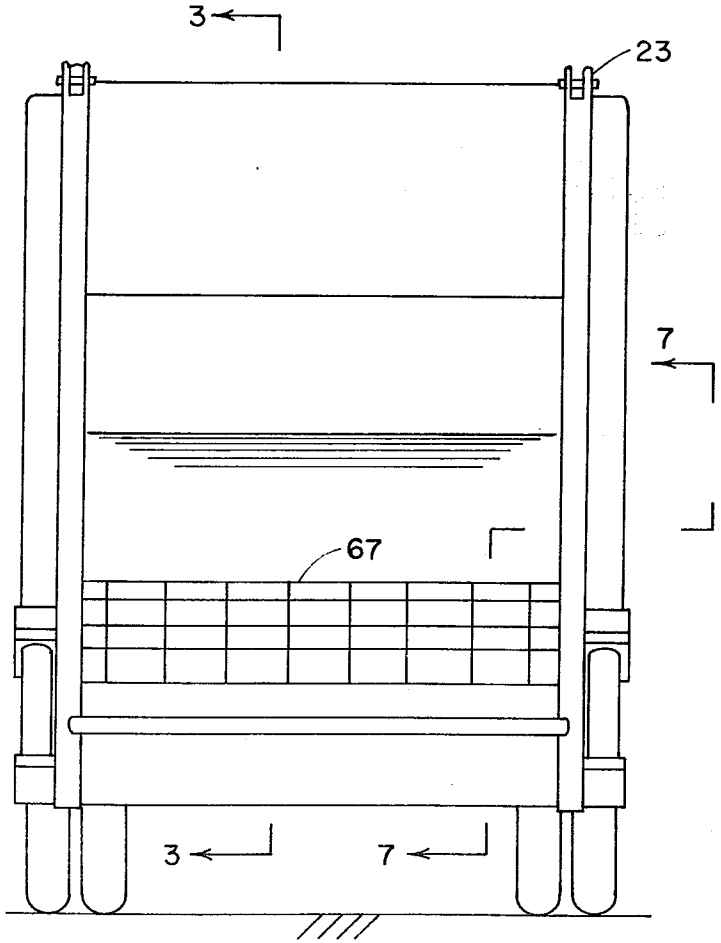
FIG. 2 is a rear elevational view of the vehicle in FIG. 1.
Figure 7:
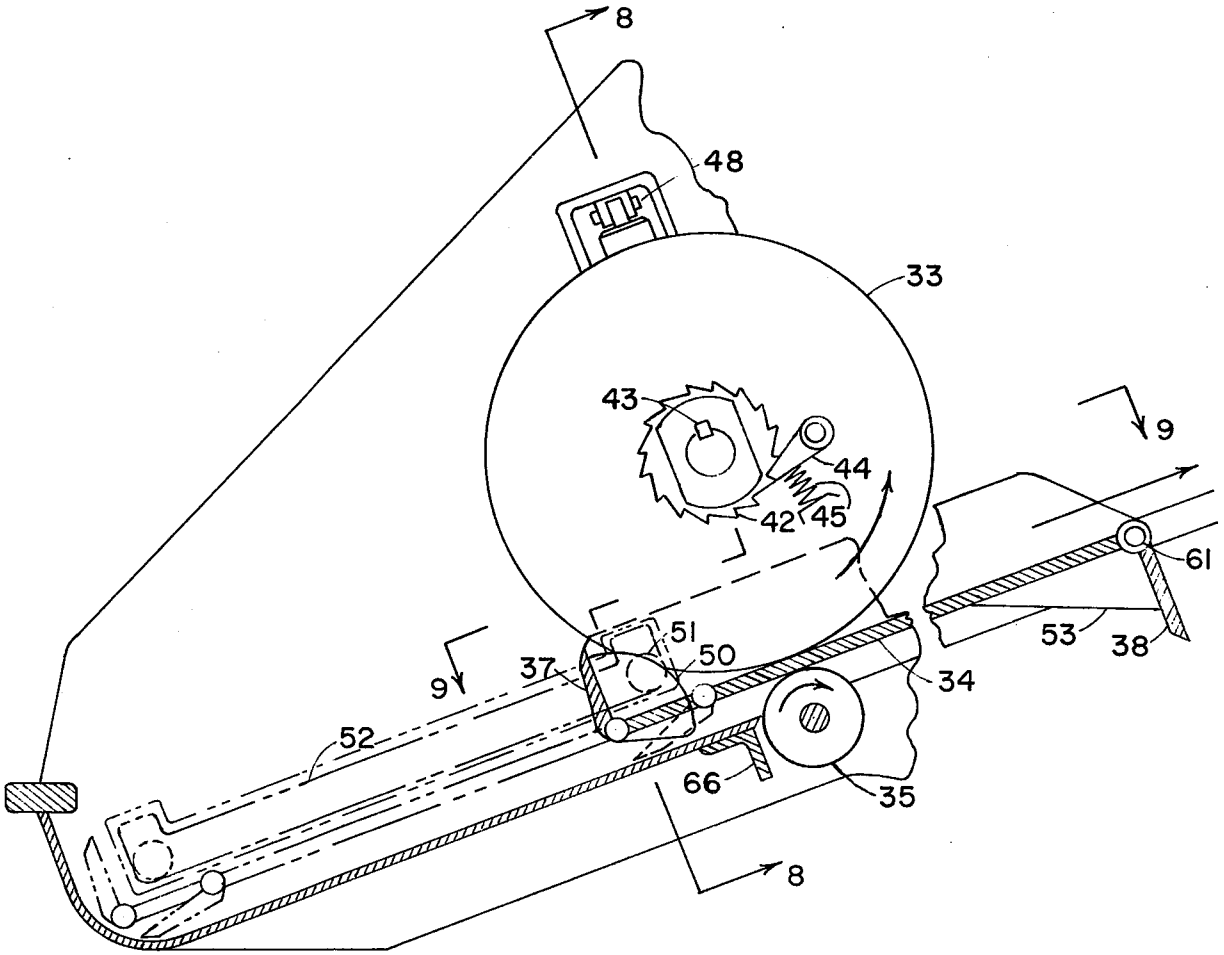

FIG. 7 is detailed sectional side view, generally taken along the lines 7—7 of FIG. 2, showing the cylindrical roller support assembly and the track and roller arrangement (partially in phantom view) controlling the position of the end gate of the translatable tray. In this view the hydraulic cylinder for pre-loading the roller and the support slot have been stripped away to expose the ratchet bearing block assembly.

Figure 8:
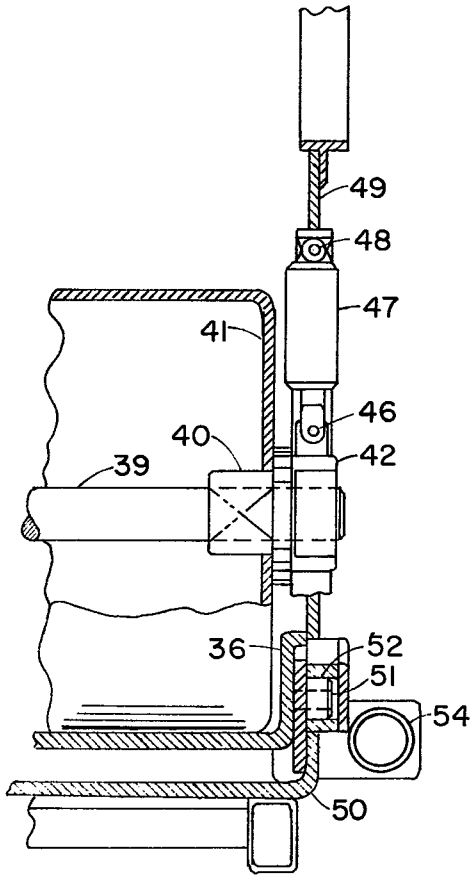

FIG. 8 is a rear view, partially in broken section, along the lines 8—8 of FIG. 7 showing in detail the roller and translatable tray relationship and supports for each of them.

Figure 9:
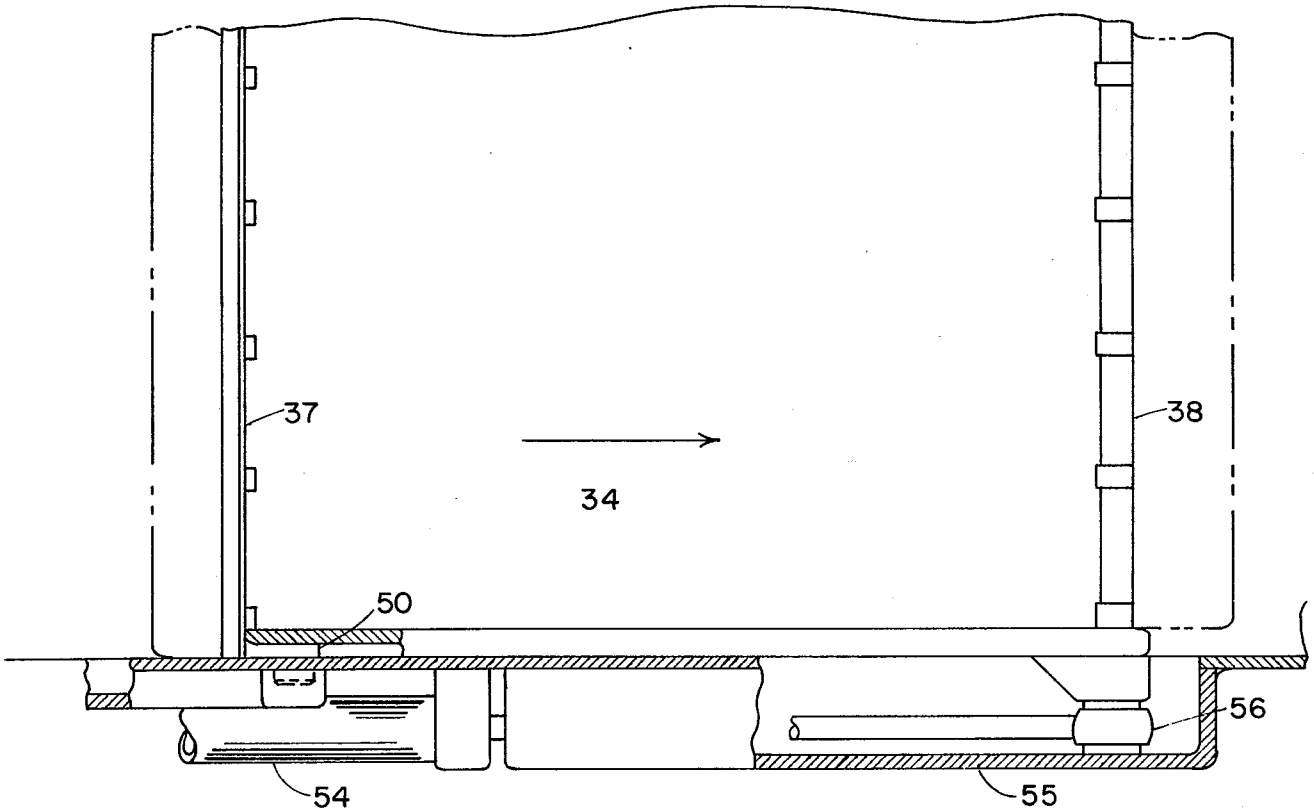

FIG. 9 is a plan view of the translatable tray taken along the line 9—9 of FIG. 7, partially in section, showing the hinged end gate and hinged storage body-oriented blade and the tray translation means.

Figure 10:
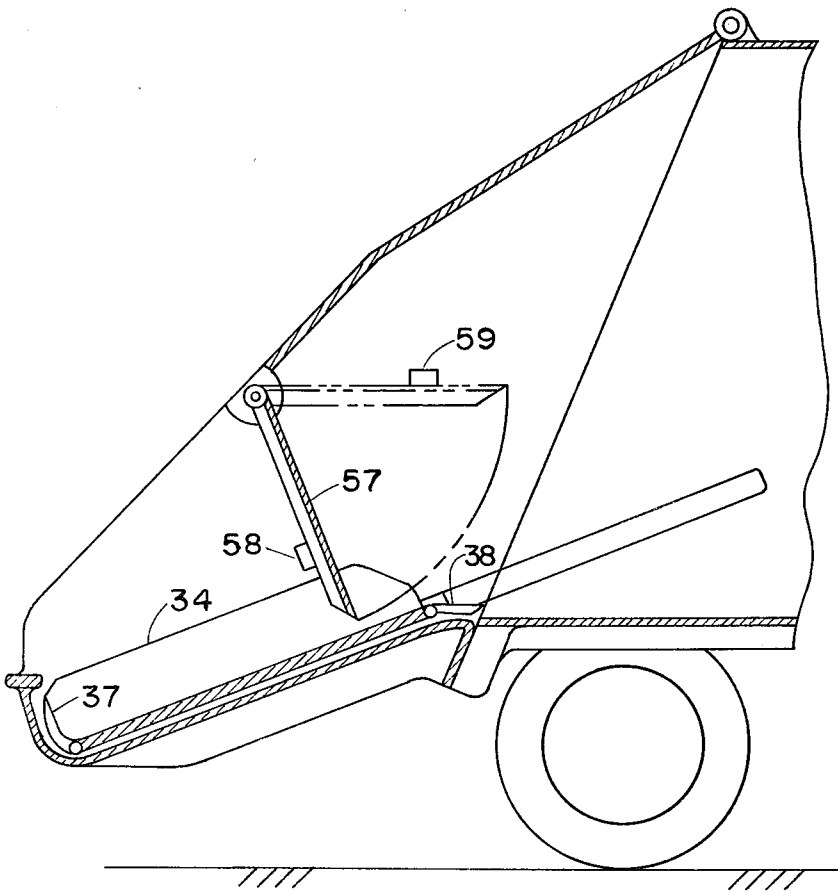

FIG. 10 is a side sectional schematic view of an alternative simplified configuration employing the translatable tray but without a rolling or crushing function.

Figure 11:
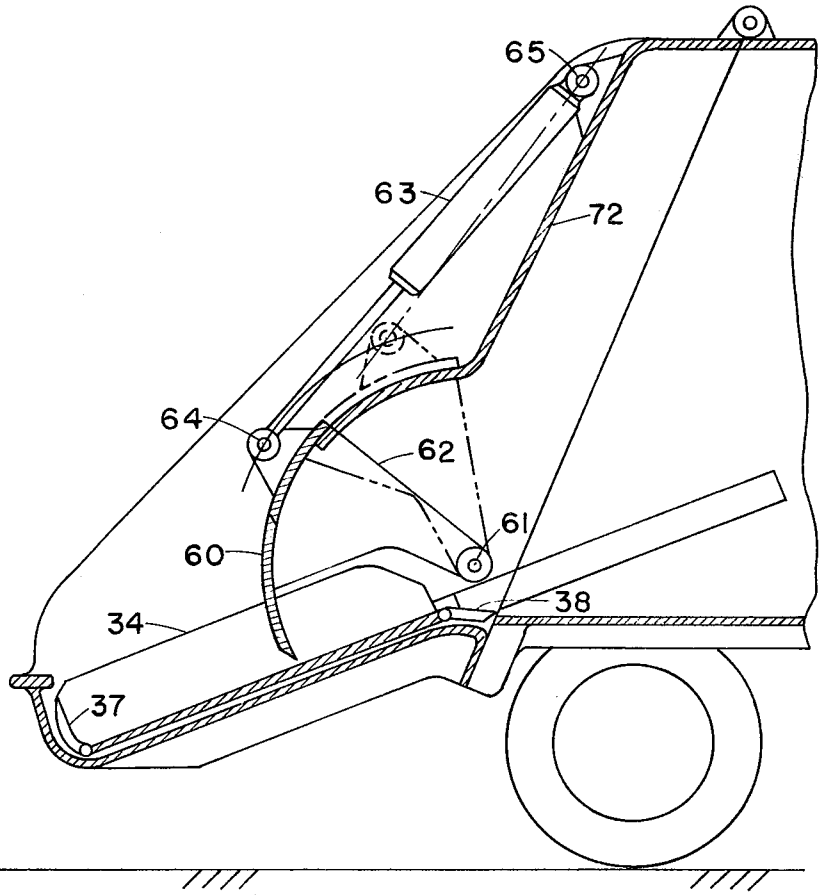

FIG. 11 is a side sectional generally schematic view of an alternative configuration to that of FIG. 10 but supplying more positively acting means for scraping material from the translatable tray and retaining it in the vehicle storage body.

Figure 12:
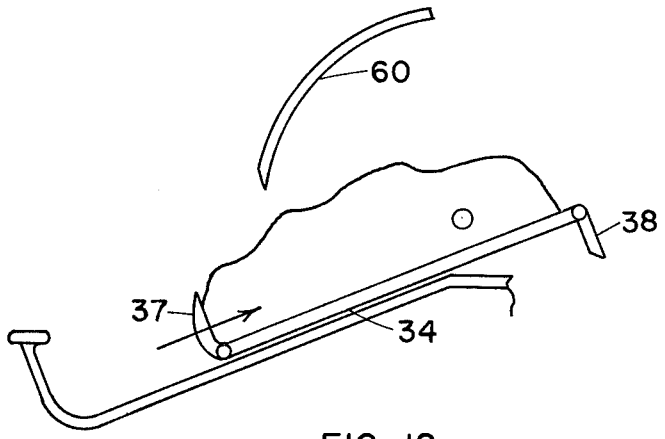
Figure 13:
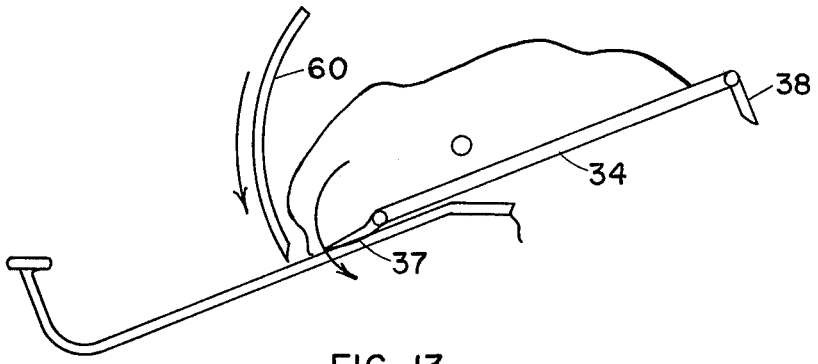
Figure 14:
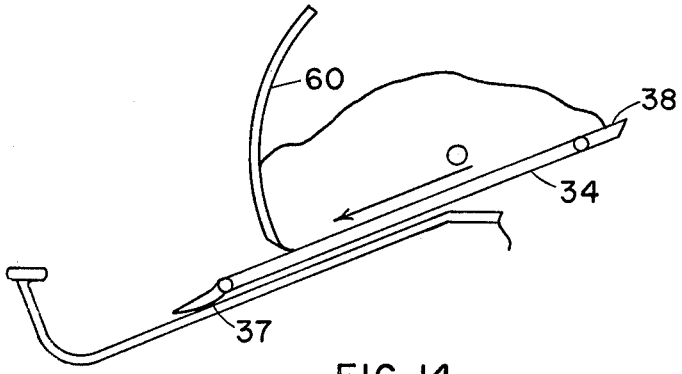

FIGS. 12, 13 and 14 show, in schematic views, the cycle of operation of the mechanism shown in FIG. 11.

Figure 15:
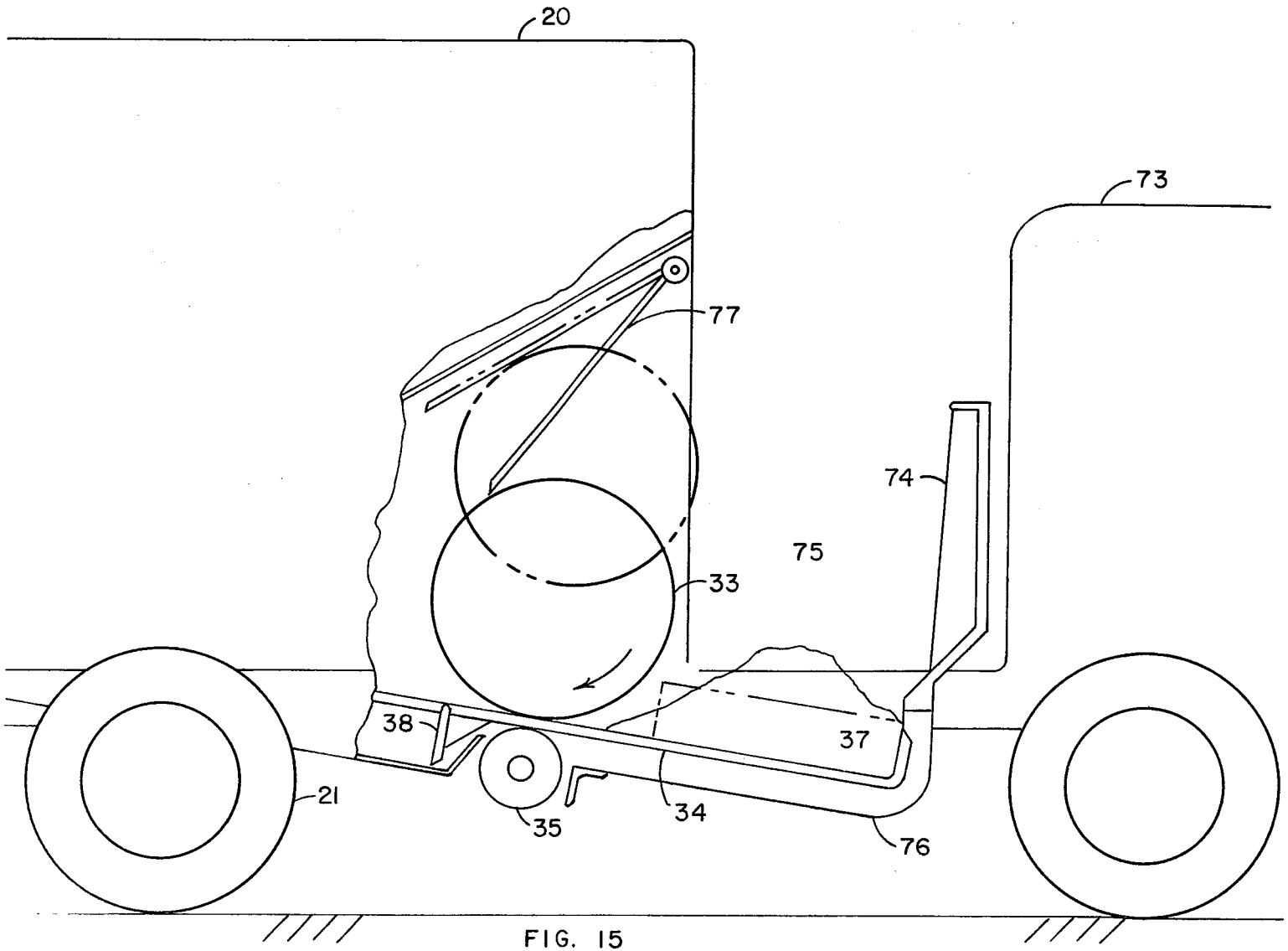

FIG. 15 shows an alternative embodiment of the invention utilized at the forward portion of a storage body.

Figure 16:
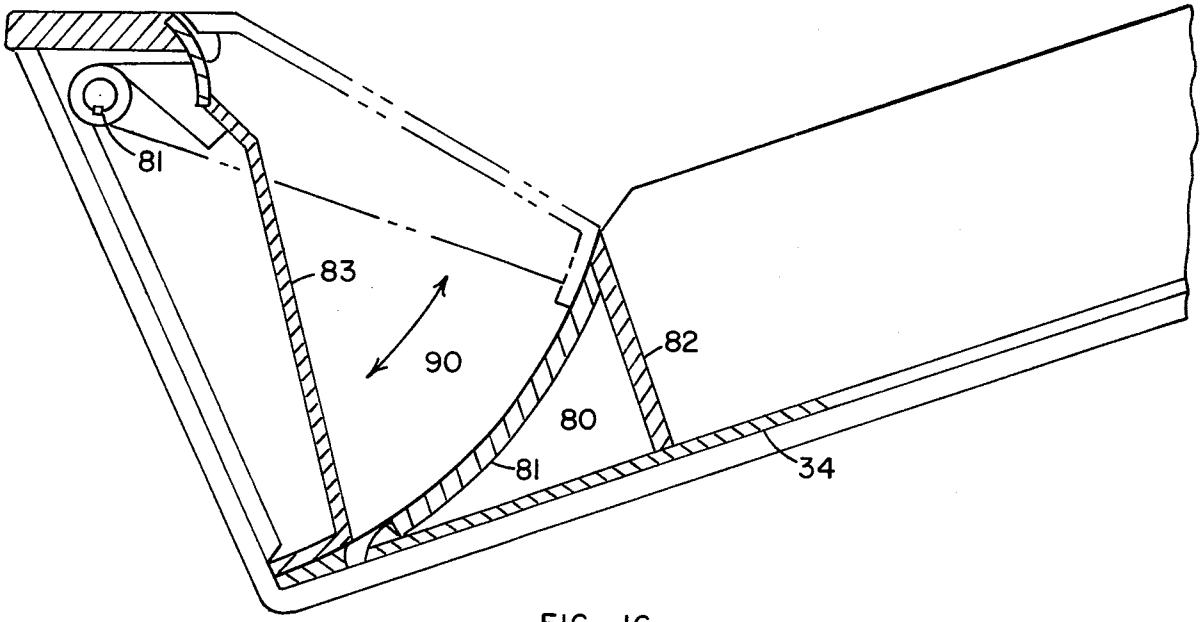

FIG. 16 shows an alternative structure to the end gate 37 shown in FIGS. 3, 4, 5, 6 and 7.

Referring to the drawings, the numeral 20 designates a material-handling or refuse storage body mounted on a truck chassis with the usual wheels 21. The storage body has a rear opening which is normally closed by a tailgate assembly 22. The tailgate assembly is hinged, as at 23, for swinging movement to facilitate unloading of the storage body. In the tailgate assembly the side walls 24 along with the bottom forming plate 25 which has an upwardly turned rear edge 26 with a lip 27 forming a hopper 28 into which material to be handled in the vehicle can be deposited. The tailgate assembly also includes top plate 29 with a lower edge 30 bridging side walls 24 and end wall 31. Top plate 29 and end wall 31 are joined along the edge 30 and, with the sidewalls of the tailgate assembly, define a volume rearwardly of the open end of the storage body defined by the line 32 which is a portion of the total storage body volume of the vehicle.

Figure 1:
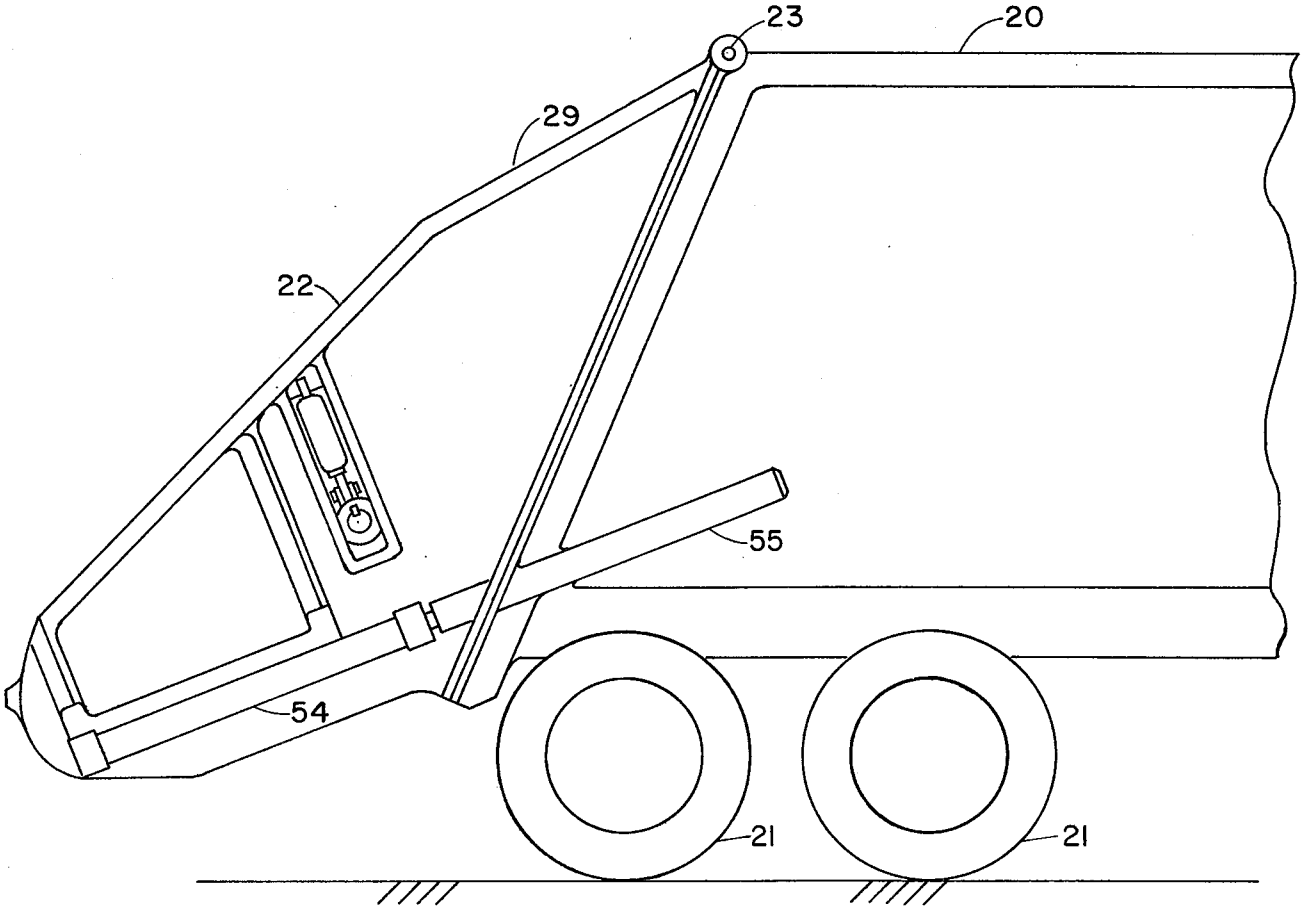
FIG. 1 is a side elevational view of a material-handling vehicle embodying the present invention.
Figure 3:
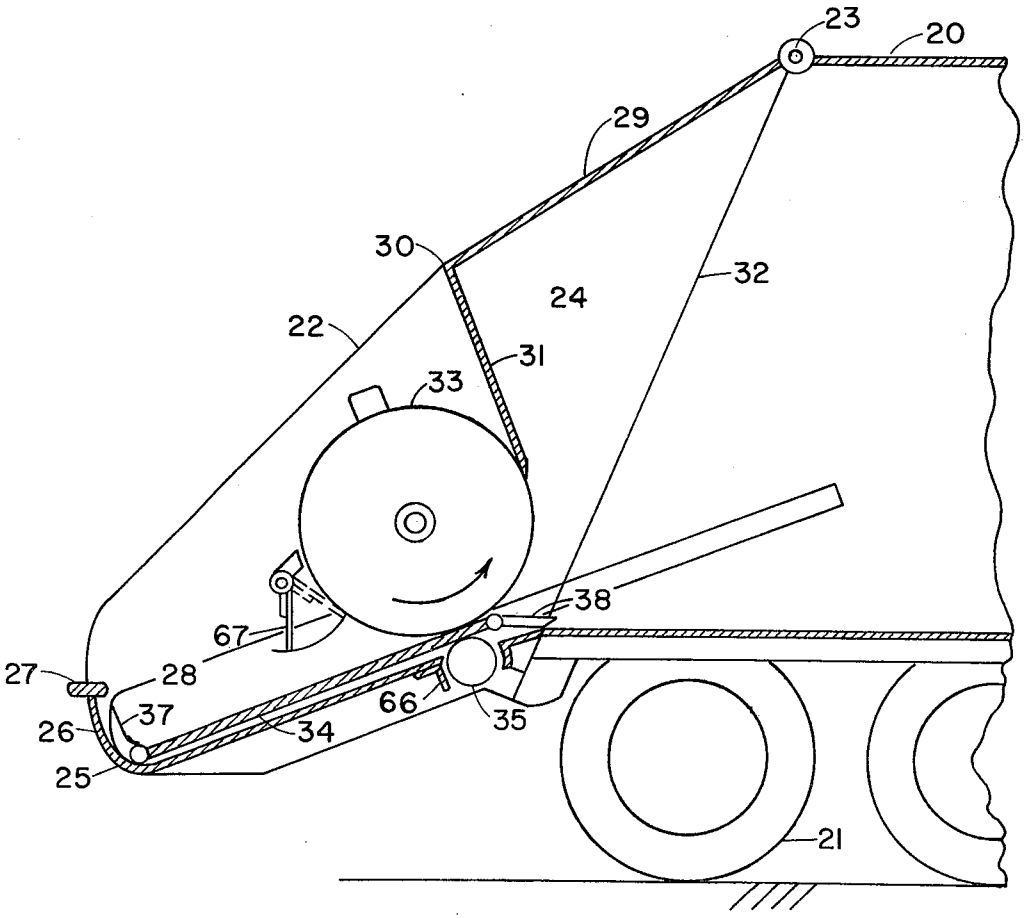
FIG. 3 is a side elevational view, taken along the line 3—3 of FIG. 2, of a material handling vehicle embodying the present invention in broken section to show schematically the relationship of the translatable tray, the cylindrical roller and the guard mechanism.

Referring to FIGS. 3, 7 and 8, the tailgate assembly also contains a material compacting and crushing mechanism primarily consisting of a cylindrical roller 33 and a planar tray 34, supported by roller 35, having upstanding sides 36, and carrying a pivotally mounted end gate 37 and a pivotally attached blade 38 at its storage body-oriented end. FIG. 3 shows the roll and planar tray relationship schematically while FIGS. 7 and 8 show details of the roller and tray mounting. The tray is translatable in a substantially horizontal motion underneath and past the cylindrical compacting roller with the roller and the material-bearing surface of the tray cooperatively providing the compacting or crushing action.

In the compacting and crushing of material, particularly refuse, inordinately large or hard, solid, objects are encountered. To permit the handling of such materials, either alone or admixed with compactable or crushable materials, the cylindrical roller 33 is desirably yieldably mounted. Such mounting must also permit a yieldable tilting action in the roller in the event that such objects encounter the roller near either of its ends. To provide such yieldable mounting, roller 33, as shown in FIGS. 7 and 8 (FIG. 8 shows in section only one end of the compacting roller, the unshown end being mounted in a duplicate manner), has a central shaft 39 which is engaged through suitable bearing means by hub 40 which is integrally attached to roller end enclosure 41, thus providing a rotational support for roller 33. Shaft 39 is in turn yieldably supported, but prevented from rotating, by ratchet slider block 42 to which it is locked by key 43. The cooperation of the teeth of the ratchet and the pawl 44, preloaded by spring 45, mounted upon the roller end closure 41 so as to engage the ratchet in the ratchet slider block 42, permits roller 33 to rotate counter-clockwise but prevents its clockwise rotation. The block portion of ratchet slider block 42 sliders in a support slot, and is connected by a pin arrangement 46 to hydraulic cylinder 47. Cylinder 47 is fastened through pin 48 to supporting member 49 which is rigidly attached to the sidewall of the tailgate assembly. The suspension of cylindrical roller 33 through the hydraulic arrangement as described permits the compacting roller to be preloaded, i.e. to be held in position in relation to the surface of translatable tray 34 so that a compacting or crushing force is applied to material carried on the surface of tray 34 by the interaction of the preloaded roller and the translatable tray.

Referring specifically to FIGS. 7 and 8 (in which, the achieve greater clarity of description, FIG. 7 shows a portion of the track-roller-end gate relationship in phantom view, the phantom lines showing the tray end gate in a hopper-oriented position) end gate 37 is pivotally connected to translatable tray 34, the ends of said gate carrying integral sectors 50 mounted perpendicularly thereto. Rollers 51 are attached to the sectors 50 and engage elongated U-shaped track 52, constraining the end gate to the upward or vertical position during the forward motion, or the downward or horizontal position during the reverse motion of the tray as activated by hydraulic cylinders 54. The track and roller combination also provides the desired angular motion of the end gate at both extremities of the stroke.

For example, during the reverse motion of tray 34, as activated by hydraulic cylinders 54, roller 51 will roll rearwardly in the bottom of the elongated U-shaped track 52. As the roller strikes the end wall of the track defining the lower upstanding arm of the U, continued rearward force exerted by hydraulic cylinder 54 causes roller 51 to continue to rotate clockwise and rise upwardly in the lower arm of the U. This is turn causes sector 50 to rotate clockwise, which in turn causes the tip of end gate 37 to sweep through the arc defined generally by the upward sweep of hopper bottom 25. Further rearward pressure exerted by cylinder 54 causes roller 51 to move downwardly in the lower arm of the U-shaped track 52, thus continuing to rotate sector 50 and end gate 37 until the end gate is in a vertical position with respect to the material-bearing surface of tray 34 or defines a slightly acute angle with respect thereto, until it reengages the elongated horizontal portion of the U-shaped track. Once the roller 51 has reentered the horizontal portion of the track, end gate 37 will be held in a substantially vertical position with respect to the tray surface for the forward motion (working stroke) of the tray. In the event reengagement of roller 51 in the horizontal portion of track 52 is not sufficiently positive to assure the desired movement and maintenance of the end gate position, a spring-activated detent can be used to urge roller 51 into such reengagement and aid in holding the end gate in position.

It will be understood that activation of the end gate at the termination of the working stroke, utilizing the forward arm of the U-shaped track, will accomplish lowering of the end gate 37 to a substantially horizontal position, the sequence of movement being merely the reverse of that described above.

It will be further understood that the length of stroke provided by cylinder 54 to tray 34 will be adjustable so that the aforedescribed interactions between roller 51 and track 52 can be effectively synchronized.

Blade 38 is pivotally fastened to the translatable tray 52 to permit it to assume a substantially horizontal or vertical position during the cyclic operation of the tray, stop 53 being provided to prevent blade 38 from pivoting beyond a substantially vertical orientation to the planar tray during the forward movement of the tray. Stop 53 will preferably be discontinuous in nature, i.e. it will be a series of triangular pieces of material of suitable strength fastened vertically to the bottom of tray 34 so that material in the storage body of the vehicle is not dragged backward on the return stroke of the translatable tray. A sufficient number of such stops will, of course, have to be positioned across the width of the tray to provide ample support for blade 38 during the forward or working stroke.

Enclosure 55 (FIG. 9) is slotted on its interior side of accommodate translation of the fastening means 56 between tray 34 and the piston rod of hydraulic cylinder 54 as the tray is moved forward and backward by the action of cylinder 54.

Support roller 35 is attached to the tailgate assembly through suitable journal assemblies and preferably extends the full width of the translatable tray to provide additional resistance to the compacting or crushing force applied through cylindrical roller 33. Alternatively, support roller 35 may be discontinuous or a series of rollers mounted on a single shaft to permit the passage between the individual rollers of reinforcing and supporting ribs vertically affixed to the bottom of tray 34.

Hopper bottom 25 is suitably fastened to bracket 66 across the full width of the hopper. Advantageously the clearance between the hopper bottom and the bottom of the translatable tray will be held to a minimum.

In the tailgate assembly end wall 31 is rigidly fastened to the said walls 24 to withstand the compacting pressure applied to material in the storage body. The lower end of end wall 31 is preferably located as close to the surface of cylindrical roller 33 as possible. It is even contemplated that it may serve as a doctor blade for roller 33 to scrape from its surface any material adhering to it. In this latter function it may be preferable to have a removable and replaceable extension for the lower end wall of 31 so that in the event of wear in operation the doctor blade function can be readily renewed without adversely affecting the integrity of end wall 31.

In FIG. 3 a guard 67 is shown in juxtaposition to the compacting roller. As depicted, guard 67 preferably comprises a solid metal or other hard surfaced plate capable of deflecting any material which is ejected outwardly toward the hopper 28 as the result of the compacting or crushing action of the roller 33 against tray 34. The guard, again as shown, is preferably pivotally mounted at 58 so that it will swing forward under the influence of material piled in the tray above the lower edge of the guard and not impede the movement of the material into the roller-tray comparting area, but will swing back under the influence of gravity to a substantially vertical position with respect to the material-carrying surface of the tray after passage of the piled material. The guard may, of course, also comprise resilient material such as heavy rubber, the resilient nature of the material permitting it to be mounted without provision for pivotal action. Also, the guard may be segmented, as shown in FIG. 2, to permit the passage of, for example, bulky material on one portion of the tray while still provide maximum screening over all other portions. In any event, the guard should extend the full width of the translatable tray and should intercept the angle defined by the lip 27 and the nip of roller 33.

Figure 4:
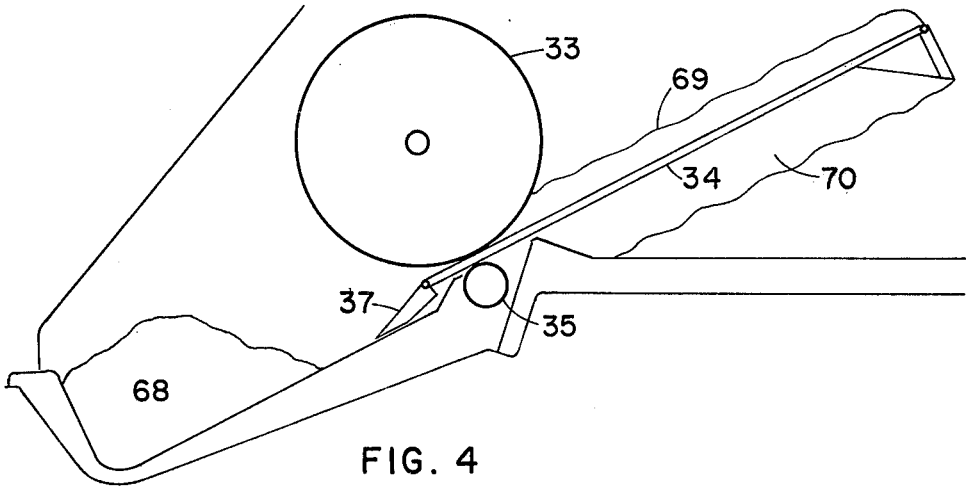
FIGS. 4, 5 and 6 show schematically and in sequence the cooperative action, in a full cycle, of the translatable tray along with its hopper-oriented end gate and pivoted storage-body end, and the cylindrical compacting roller.
Figure 5:
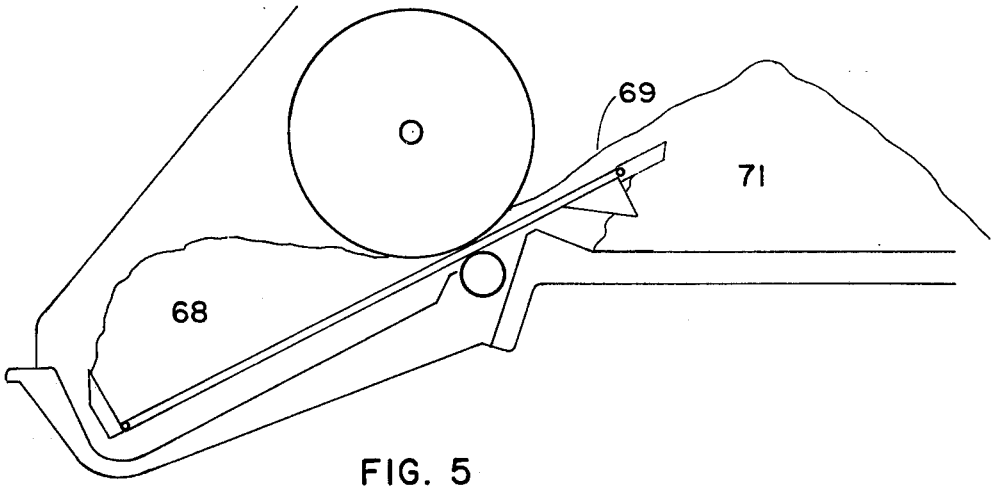
Figure 6:
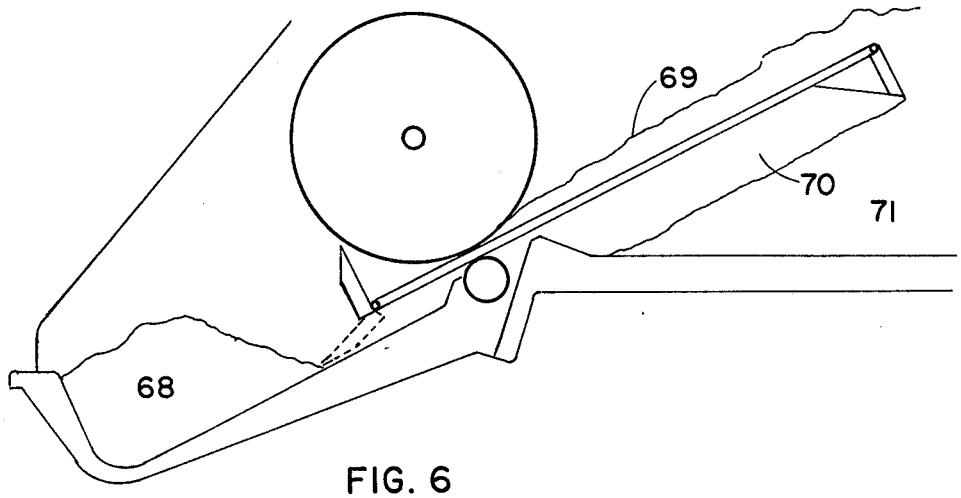

The sequence through which the translatable tray accomplishes the transfer of material deposited in hopper 28, through a compacting or crushing action in cooperation with roller 33, into storage body 20 is schematically shown in FIGS. 4, 5 and 6.

In FIG. 4 the tray 34 is shown in its fully forward position with end gate 37 in its lowered position and with material, such as refuse, 68 piled in the hopper 28. As the tray 34 is retracted to the hopper-oriented position through the action of hydraulic cylinder 54, the refuse in the hopper is scooped onto the tray by end gate 37. When the completely retracted position has been achieved as shown in FIG. 5 (end gate 37 having been translated from the substantially horizontal position as shown in FIG. 4 to the vertical position shown in FIG. 5 through the activation of sector 50 by roller 51 moving in track 52 as hereinbefore described — the translational positions being shown in FIG. 7 by dashed lines adjacent lip 27), the material in the hopper has been transferred to the tray also as shown in FIG. 5.

During retracting of the tray the material on its surface, which has been subjected to compacting action during the previous cycle and is designated by numeral 69, is pushed off the end of the tray through the action of the roller as a barrier, the roller being held from rotating in a clockwise motion by ratchet assembly 42 and pawl 44. The material pushed off the tray falls into the void space 70 in the compacted material 71 in the storage body 20 created by the blade 38 aligned against stop 53 as it was previously pushed through the material in the storage body. During this retraction blade 38 is free to pivot upwardly and align itself with the tray surface (as shown in FIG. 5) so compacted material is not pulled back towards the roller. It will be apparent that blade 38 by ram action resulting from the tray movement serves to distribute and compact the material in the storage body.

After material in the hopper has been transferred to the tray with end gate 37 in a vertical position (FIG. 5), the hydraulic cylinder 54 is activated to move tray 34 carrying uncompacted material 68 forward so that the material is forced under roller 33 which is caused to rotate by contact with the moving tray and the material carried on it (the working stroke of the cycle). As pointed out hereinbefore, the roller is forcibly engaged with the tray surface through the pre-loading effected by hydraulic cylinder 47 through the slide block bearing arrangement 42 with support roller 35 providing reaction against the compacting and crushing loads applied against the tray surface by roller 33.

The delivery of material to the nip of the roller for compacting or crushing is accomplished through gravitational and frictional effects and by the positive pushing action of end gate 37. After compaction the compacted material lies on the tray surface as at 69.

During the working stroke blade 38 drops into a vertical position against stop 53 through the effect of gravity or as the result of encountering compacted material which has fallen into void space 70. (Pivot 61 is designed so that the blade 38 cannot assume a position above alignment with the tray surface as shown in FIG. 5.) On the working stroke blade 38 pushes ahead of it any material in the roller region and compacts it by ram action within storage body 20.

After the tray has reached the approximate position shown in FIG. 6 in the working stroke, the movement of roller 51 in track 52 activates sector 50 (FIG. 7) to drop the end gate to the position shown in dotted lines in FIG. 6 (previously described) to prevent end gate 37 from impinging on roller 33. The tray continues in its forward movement in the cycle after the end gate has dropped until it reaches the position shown in FIG. 4. After return to the FIG. 5 position, the tray-roller mechanism is considered to be in its normal standby position for loading of the hopper.

FIG. 10 illustrates a more simplified version of a tailgate mechanism for material-handling vehicle bodies embodying principles of the present invention but not employing the rolling compacting or crushing feature. In this embodiment of the invention the end gate 37 of the translatable tray along with the blade 38 serves to move material placed in the tailgate hopper into the vehicle storage body and to compact it therein — the translatable tray and mechanism associated therewith and its operation being identical to that described hereinbefore with particular reference to FIG. 7.

Thus, in operation, material can be deposited upon the translatable tray 34 within the hopper as shown.

Upon actuation of the hydraulic system (by means well known in the art) the material-bearing tray is caused to move forward. The material on the tray surface is forced against pivoted baffle 57 causing it to swing upward and permitting the material to be transported into the vehicle storage body. Stop 59 limits the upward swing of baffle 57 to prevent it from being "hung up" on material previously moved into the storage body. At the same time blade 38 functions as previously described to compact material already in the storage body or, before the storage body contains a significant volume of material to be compacted, to distribute the material in the storage body. When the translatable tray has reached its most forward position and the return stroke commences, baffle 57 swings downwardly through the action of gravity to a position against stop 58. In this position baffle 57 serves to scrape the material from the surface of the translatable tray on the return stroke of the tray so that the material will be retained within the storage body of the vehicle.

It will be evident that the safety disadvantages inherent in the well known scraper-packer assemblies are avoided and that baffle 57 tends to prevent fall-back of the material within the storage body, maintaining a substantial closure of that body at all times.

FIG. 11 illustrates an alternative embodiment of the present invention to that shown in FIG. 10 so as to provide a more positively acting mechanism for retaining material within the vehicle storage body and for scraping material from the translatable tray.

In the tailgate mechanism of FIG. 11 translatable tray 34 with its pivoted end gate 37 and compacting storage body-oriented blade is identical with that shown and described in FIGS. 7, 8 and 9 and operates in the same manner as earlier described with reference to those figures. To obtain better retention of material in the vehicle storage body and more positive removal of material from tray 34 on the retraction of the tray from its forward position, an arcuate scraper 60 is provided, supported by arms 62 at each of its ends which are pivotally fastened to the side walls of the tailgate at 61. The side arms are mounted to afford minimum clearance between them and tailgate side walls. Scraper 60 extends the full width of the tailgate between the support arms 62, with its front edge extending beyond the leading edge of the support arms a distance approximately equal to the height of the side walls 36 of the translatable tray. The leading edge is also end-notched to permit it to fit between the upstanding side walls of the translatable tray, as shown in the position indicated by solid lines in FIG. 11. The scraper is connected, preferably at each end, by a suitable pin assembly at 64 to the piston rod of double acting hydraulic cylinder 63, the opposite end of cylinder 63 being fastened to the main tailgate structure, as by pin arrangement 65.

In operation, material may be deposited in the hopper with scraper 60 in either the "down" position (shown in solid lines) of the "up" position (shown in dashed lines), the trailing edge of the scraper in the "up" position riding over the top of the arcuately configured section of tailgate end wall 72 as shown in FIG. 11. Also, the translatable tray may be in hopper position, as shown, or in the forward position during loading. When the loaded material is in tray 34 and it is desired to move it into the vehicle storage body, scraper 60 will have to be placed in its "up" position to permit movement of the material into the storage body as shown schematically in FIG. 12. After translatable tray 34 has been moved, as previously described, to its maximum forward position and end gate 37 has assumed a position substantially coextensive with the tray, cylinders 63 are activated to lower scraper 60 to the position shown in FIG. 13 with its leading edge just above the material-bearing surface of the tray (if desired the leading edge of scraper 60 can be brought into contact with the tray surface). Translatable tray is now moved back to its hopper-oriented position and during such movement the material is scraped from the tray surface as shown in FIG. 14.

It will be understood that hydraulic cylinders 63 will be provided with appropriate pressure relief means so that in the event scraper 60 is lowered and the leading edge impinges upon a bulky object in the tray, such means will operate to prevent damage to the mechanism. Also, the piston travel of these cylinders will be readily adjustable to control the movement limits of scraper 60. All such control and safety means are not shown but are well known to those skilled in the art.

In all of the embodiments described herein and those within the scope of the appended claims it will be evident that material can be continuously dumped into the tailgate hopper without regard for observing any particular time cycle in the mechanism and that there need be no delay in movement of the translatable tray, the reverse stroke being capable of immediately following the forward or working stroke of the tray.

Means for activating the hydraulic cylinders as well as any ancillary control equipment to accomplish the described cycles for handling, or compacting or crushing material are well known to those skilled in the art and are not therefore shown. Also, it will be understood that unloading of the storage body can be accomplished by means well known in the art. For example, the tailgate assembly can be swung at pivot point 23 rearwardly in an out-of-the-way position by a suitable hydraulic or other mechanism to enable the contents of storage body 20 to be discharged rearwardly upon the storage body being tilted by conventional operating means as shown, for example in U.S. Pat. No. 3,866,778. Alternatively the storage body contents may be discharged by a movable partition plate as shown in U.S. Pat. No. 3,220,586.

Various changes and modifications can be made in the mechanisms as illustrated in the accompanying drawings without departing from the spirit of the present invention. For example, and as pointed out hereinbefore, compacting roller 33 may be independently driven by suitable means during the crushing or compacting cycle. Also, various other arrangements for positioning end gate 37 and blade 38 and means for translating the tray will be readily apparent to those skilled in the art.

While a rolling compaction mechanism for refuse has been described with particular reference to tailgate mounting which is generally similar in arrangement to conventional rear end packer systems wherein refuse is loaded into a receiving hopper extending transversely across the rear of the vehicle, a further embodiment will be described in which the receiving hopper is located forward of the enclosed storage compartment. Such a structure is shown in partial section in FIG. 15. It will be understood that in this drawing that numbers identical to those used in the previous figures indicate equivalent or identical structures, and that with respect to structure not particularly shown in drawing 15, it is intended and understood that such additional structure shown in the previously described embodiment necessary to achieve an operative structure should also be incorporated.

In the embodiment of FIG. 15 a large compacting roller 33 is located rearwardly of a truck cab 73. An intervening gap shown generally at 75 is provided for loading material to be transported beneath the roller 33 into storage volume 20. A frame 76 may be provided of such a shape so that proper clearance and geometrical relationships may be achieved for creating a loading space 75 and for insuring the proper relationship of the elements of the described compacting mechanism. As in the embodiment of FIG. 7 a tray 34 is provided for translational motion beneath roller 33 to induce the refuse material into the nip between roller 33 and tray 34. Blades 37 and 38 are utilized to compact the refuse in the storage body 20 and for forcing the refuse material into the nip respectively. Such structure operates in a similar fashion to the previously described embodiment and includes similar structure as that shown in that embodiment. A pivotable door 77 is also shown which may be utilized to define the storage volume 20. Unloading of refuse from storage volume 20 in the embodiment of FIG. 15 could involve using a conventional pusher blade to move material backward out of the body, although unloading could also be accomplished by means of tilting as in a dump truck. In the latter embodiment the entire rolling compaction mechanism may be rotated with the body or rigidly mounted to the truck frame, having the advantage of eliminating the need to raise the weight of the compaction mechanism, but would require mechanical decoupling between the mechanism and the body. Although the particular structure shown is truck-mounted, the embodiment is adaptable to a tractor-trailer combination wherein all the collection equipment may be integral with the trailer. The embodiment of FIG. 15 is neither a packer nor a tailgate mechanism but utilizes rolling crushing as the previous embodiments do to minimize the necessity for internal pressure in the storage box 20.

The embodiment of FIG. 15 also allows several operational advantages. In curb pickup, refuse material is moved a shorter distance from either the near or far curb. This will allow less travel time for personnel since the wal from the cab to the rear of the unit is eliminated. Loading hopper storage capacity is increased by a transverse baffle 74 forward of the loading area 75.

The center of gravity of the overall truck loading is also lowered; and is also moved forward a significant distance, reducing overhang on the rear wheels particularly during unloading when the conventional tailgate is extended upward and backward. For a given fore and aft dimension from the rear of the tailgate mechanism to the forward edge of the main storage box, the available storage volume is considerably increased.

The particular structure of FIG. 15 also allows several safety improvements. The danger due to empowered swing-out of the tailgate mechanism during ejection is avoided if the load is dumped. The driver will be in much better visual contact with other personnel to avoid accidental dragging, and will be able to see the loading region at all times and to know the condition of the hopper. Blind backing to a dock or storage hopper is eliminated. The danger to personnel from fly-back articles during crushing is avoided as they move directly back to the baffle 74, and auxiliary transverse guard would not be required behind the roll 33. The danger of accidental injury due to the rear end collision with personnel at the tailgate is eliminated; such personnel would tend to ride in the cab rather than on the rear steps.

FIG. 16 shows an embodiment alternative to the articulated pivoted end gate 37. The structure shown is a fixed cleat generally shown at 80 attached to the translatable tray 34. The fixed cleat is also coextensive in size with the roller 33 and with the transverse dimension of the plate 34 perpendicular to its direction of translation. The cleat may be constructed of a vertical flat metal sheet 82 to which is attached a section 81 of arcuate shape. One edge of the arcuate section 81 is attached to the transverse edge of the tray 34 nearest the hopper, the section 81 being perpendicularly attached to tray 34 a distance away from said transverse edge along a direction perpendicular to the direction of translation of tray 34. The other edge of section 81 is attached to the edge of section 82 remote from tray 34. The structure shown eliminates the more complicated mechanism of the continuous hinge, tracks and rollers of the articulated pivoted end gate 37.

In operation during the forward stroke (to the right) of the translatable tray 34, refuse will be conveyed by the flat surface of sheet 82 into the nip between roller 33 and translatable tray 34. However, a small amount of refuse may remain between the cleat 80 and the roller 33. On the return stroke the curved section 81 will tend to plow under material in hopper 90. Of course, the hopper 90 itself cannot be completely scavenged. Provision therefore may be made for a transverse pivotable plate 83 pivoted about point 84 on the hopper. Material remaining in the hopper 90 can be lifted and shed ahead of the cleat by swivelling plate 83. This transverse swivel plate is also coextensive with the width of cleat 80 and consequently with tray 34, and is pivoted at a length equal to the radius of arc of the arcuate surface of plate 81 so that a close fit can be obtained between the lower edge of plate 83 and the arcuate surface. A further advantage of the structure of FIG. 16 is that the tray 34 can stall in any advancing position if overloaded, whereas in the mechanism of FIG. 7, it must reach the slot position of track 52 to actuate.

The compaction mechanism described achieves substantial density improvement. One method of estimating such improvement is to assume the voids inherent in cans and bottles are substantially eliminated by rolling whereas normal packing pressures are insufficient to cause such destruction. A conservative estimate would be that cans and bottles are reduced to one-third of their original volume. With a full scale highly loaded roller, greater reductions may be achieved. Typically a 15% by volume component of a typical refuse container is made up of cans and bottles. Therefore, their volume may be reduced to 5% of the original total volume corresponding to a 10% improvement in density of the refuse if no other components are compacted. Assuming an additional 50% packer type compaction of compressibles in the refuse, the density improvement factor by the permanent elimination of container voids is roughtly on the order of 20%. If the packer compression factor is 90% the density improvement factor becomes on the order of 74%, approaching the doubling of packing density. The effect of thus reducing container voids becomes dramatic at greater compressions where the increment of 10% of container compaction of cans and bottles becomes relatively more important.

In the structure shown in FIG. 7, hinged blade 38 is utilized to distribute the rolled refuse in the body 20. However, as the body is enclosed, as the load increases the blade will begin to recompress most elastic materials and perform a packing function. The compaction pressure available is related to the capacities of the tray cylinders 54 and to the frontal area of the blade 37. If the blade 37 is on the order of 10 inches by 72 inches in cross section, an internal pressure on the refuse is created on the order of 30 psi by the cylinders 54 and the ram force on either side of the tray is roughly 10,800 pounds. At 1500 psi hydraulic pressure, this requires only a 3 inch diameter cylinder. Such cylinders must simultaneously feed the roller, but 4 inch diameter cylinders should be sufficient.

As is shown in FIG. 3, the roller can be raised hydraulically to faciliate the entry of white goods, such as old washing machines and household appliances. In this instance the roller is raised to a height corresponding to its own radius or 18 inches causing a bite of 6 inches on 24 inch objects. To achieve this the piston stroke of cylinders 47 should be appropriately selected. Large items such as white goods tend to fall downward and forward of blade 38 after retraction of the tray 34. On the next forward stroke they will tend to be pushed a full stroke forward by the blade 38.

Feeding by means of a reciprocating tray 34 is not necessarily a slow process. It is true that while the area swept by the cleat 80 is small relative to the packer blade 38, tray 34 may be caused to oscillate continuously at a fairly high rate and at a rate which is adjustable. Additionally, many soft materials may be forced into the nip though piled well above the tip of the cleat.

While the embodiments shown and described herein relate to vehicles for the collection of trash and refuse it will be obvious that the structures disclosed herein may be applicable to stationary structures utilized for the compaction of trash and refuse. Various changes in modifications can be made in the mechanisms as illustrated in the accompanying drawings without departing from the spirit and scope of the present invention as defined in the appended claims.

What is claimed is:

1. In a material handling apparatus for handling large volumes of refuse having a storage body and a hopper in communication with said body, means interposed between said hopper and storage body to move material from said hopper into said storage body comprising a planar material-holding tray mounted for translation beneath a cylindrical roller in material compacting relationship therewith, whereby at least part of said material is compacted by the nip pressure of rolling action during movement from said hopper with said body and said storage body is loaded with refuse by successive translations of said holding tray.

2. The material handling apparatus of claim 1 wherein the width of the cylindrical roller and the translatable tray are substantially co-extensive.

3. The material handling apparatus of claim 1 wherein the material to be compacted on the tray is positively moved into the nip of the roller by forcing means projecting from and translatable with the tray.

4. The material handling apparatus of claim 3 wherein said forcing means comprises a pivotally mounted end gate on the hopperoriented end of the tray.

5. The material handling apparatus of claim 4 wherein means is provided for rotating said end gate about its pivoted mounting from a substantially colinear orientation with said tray to a substantially perpendicular orientation thereto, the rotational motion deriving mechanically from the rearward translatory motion of said tray.

6. The material handling apparatus of claim 4 wherein means is provided for rotating said end gate about its pivoted mounting from a substantially perpendicular orientation with said tray to a substantially colinear orientation thereto, the rotational motion deriving mechanically from the forward translatory motion of said tray.

7. The material handling apparatus of claim 5 wherein the end gate is held in a substantially perpendicular orientation to said tray during a major portion of its forward translatory motion.

8. The material handling apparatus of claim 5 wherein the end gate is held in a substantially colinear orientation with said tray during its rearward translatory motion.

9. The material handling apparatus of claim 1 wherein the storage body-oriented end of the translatable tray contains integral means for compacting the material within the storage body.

10. The material handling apparatus of claim 5 wherein said integral means is coextensive with the tray width.

11. The material handling apparatus of claim 6 wherein said integral means is pivotally mounted on the tray end.

12. The material handling apparatus of claim 1 wherein means are provided to advance the translatable tray from a hopper floor-covering position beneath and past the cylindrical roller, in material compacting relationship therewith, whereby material on said tray is compacted and delivered to the storage body, and to retract the tray to its hopper floor-covering position.

13. The material handling apparatus of claim 12 wherein the means for rotating the cylindrical roller in material compacting relationship with the translatable tray is the frictional engagement between tray-held material and the roller as the tray is advanced beneath and past said roller.

14. The material handling apparatus of claim 13 wherein means are provided to prevent the cylindrical roller from reversing in rotation during retraction of the translatable tray.

15. The material handling apparatus of claim 12 wherein independent driving means is provided to rotate the roller in material compacting relationship with the translatable tray.

16. The material handling apparatus of claim 2 wherein the cylindrical roller is yieldably mounted with respect to the translatable tray.

17. The material handling apparatus of claim 2 wherein the cylindrical roller is yieldably and tiltably mounted with respect to the translatable tray.

18. The material handling apparatus of claim 2 wherein the cylindrical roller is characterized by a surface enhancing its material compactingcapability.

19. The material handling apparatus of claim 2 wherein the materialholding surface of the translatable tray is characterized by a surface enhancing its material compacting-capability.

20. The material handling apparatus of claim 2 wherein the cylindircal roller and the material-holding surface of the translatable tray are characterized by cooperating surface configurations enhancing their compacting capability.

21. The material handling apparatus of claim 2 wherein a safety shield is interposed between the hopper opening and the cylindrical roller to prevent ejection of material from said hopper occasioned by the material compacting action between said roller and translatable tray.

22. In a material handling apparatus having a storage body and a hopper in communication with it, a planar material-hold tray translatable from a position within said hopper to a position within said storage body, said tray having a pivotally mounted end gate at its hopperoriented end, means for orienting said end gate in a position substantially perpendicular to the surface of said tray, and means for translating said tray from said hopper into said storage body, whereby material in said tray is moved from said hopper into said storage body in successive translations to load said storage body with said material.

23. The material handling apparatus of claim 22 wherein gate means is interposed between said hopper and said storage body above said tray, said gate means being pivoted to swing forwardly as said tray is translated from said hopper into said storage body and material and material carried by said tray impinges against it and rearwardly to a fixed position by the impingement of material carried by said tray as the tray is translated rearwardly from said storage body into said hopper, said gate means providing a barrier against the return of material carried by said tray from said storage body back into said hopper during the rearward translation of said tray.

24. The material handling apparatus of claim 22 wherein movable barrier means is interposed between said hopper and said storage body, said barrier means comprising a substantially vertically adjustable baffle affording a closure for the communicating opening between said hopper and said storage body.

25. The material handling apparatus of claim 24 wherein said vertically adjustable baffle functions to scrape material from said translatable tray during its rearward translatory movement from said storage body to said hopper.

26. The apparatus of claim 3 wherein said forcing means comprises a cleat permanently affixed to said tray.

27. The apparatus of claim 26 wherein said cleat comprises an arcuate section and a planar section, said planar section being affixed perpendicular to said tray remote from the end thereof nearest said hopper providing a face for engaging said material and said arcuate section being disposed between the end of said tray nearest said hopper and the edge of said planar section remote from said tray, said arcuate and planar sections being coextensive with the dimension of said tray perpendicular to the direction of translation of said tray.

28. The apparatus of claim 27 further including scraping means capable of removing material lodged in said hopper against the arcuate surface of said arcuate plate most remote from the tray.

29. The apparatus of claim 28 wherein said scraping means is plate pivoted at a length corresponding to the radius of arc of said arcuate plate so as to be able to maintain contact at an edge thereof with the arcuate surface of said arcuate plate.

30. The apparatus of claim 25 disposed on a vehicle, said hopper being disposed behind the storage body on said vehicle.

31. The apparatus of claim 25 disposed on a vehicle, said hopper being disposed in front of the storage body on said vehicle.

32. The apparatus of claim 29 disposed on a vehicle, the hopper being disposed behind said storage body on said vehicle.

33. The apparatus of claim 29 disposed on a vehicle, the hopper being disposed in front of said storage body on said vehicle.

* * * * *